United States Patent [19]

Rankel

[11] Patent Number: 4,814,065

[45] Date of Patent: Mar. 21, 1989

[54] ACCELERATED CRACKING OF RESIDUAL OILS AND HYDROGEN DONATION UTILIZING AMMONIUM SULFIDE CATALYSTS

[75] Inventor: Lillian A. Rankel, Princeton, N.J.

[73] Assignee: Mobil Oil Company, New York, N.Y.

[21] Appl. No.: 100,868

[22] Filed: Sep. 25, 1987

[51] Int. Cl.[4] ..... C10G 55/04

[52] U.S. Cl. ..... 208/85; 208/56; 208/88; 208/107; 208/125; 208/131

[58] Field of Search ..... 208/56, 107, 125, 106, 208/85, 88, 145, 131

[56] References Cited

U.S. PATENT DOCUMENTS

| | | | |
|---|---|---|---|
| 3,803,259 | 4/1974 | Porchey et al. | 208/106 |
| 4,216,078 | 8/1980 | Plumlee et al. | 208/56 |
| 4,298,455 | 11/1981 | Huang | 208/106 |
| 4,448,665 | 5/1984 | Zaceepinski et al. | 208/107 |
| 4,454,024 | 6/1984 | Singhal | 208/56 |
| 4,465,584 | 8/1984 | Effron et al. | 208/158 |
| 4,560,467 | 12/1985 | Stapp | 208/107 |
| 4,587,007 | 5/1986 | Rudnick | 208/107 |
| 4,615,791 | 10/1986 | Choi et al. | 208/56 |
| 4,659,453 | 4/1987 | Kukes et al. | 208/107 |
| 4,661,241 | 4/1987 | Dabkowski et al. | 208/56 |

*Primary Examiner*—Anthony McFarlane

*Attorney, Agent, or Firm*—Alexander J. McKillop; Michael G. Gilman; Van D. Harrison, Jr.

[57] ABSTRACT

Disclosed is a method for accelerating the exchange of hydrogen between a hydrogen donor and a petroleum resid to be subjected to cracking, visbreaking, or coking. Acceleration is effected by incorporating an aqueous solution of ammoniun sulfide into the mixture of donor and resid and subjecting the mixture to a period of heat-soaking at an elevated temperature.

9 Claims, 1 Drawing Sheet

FIGURE 1. H-Donor Presoak with Aqueous Ammonium Sulfide Catalyst

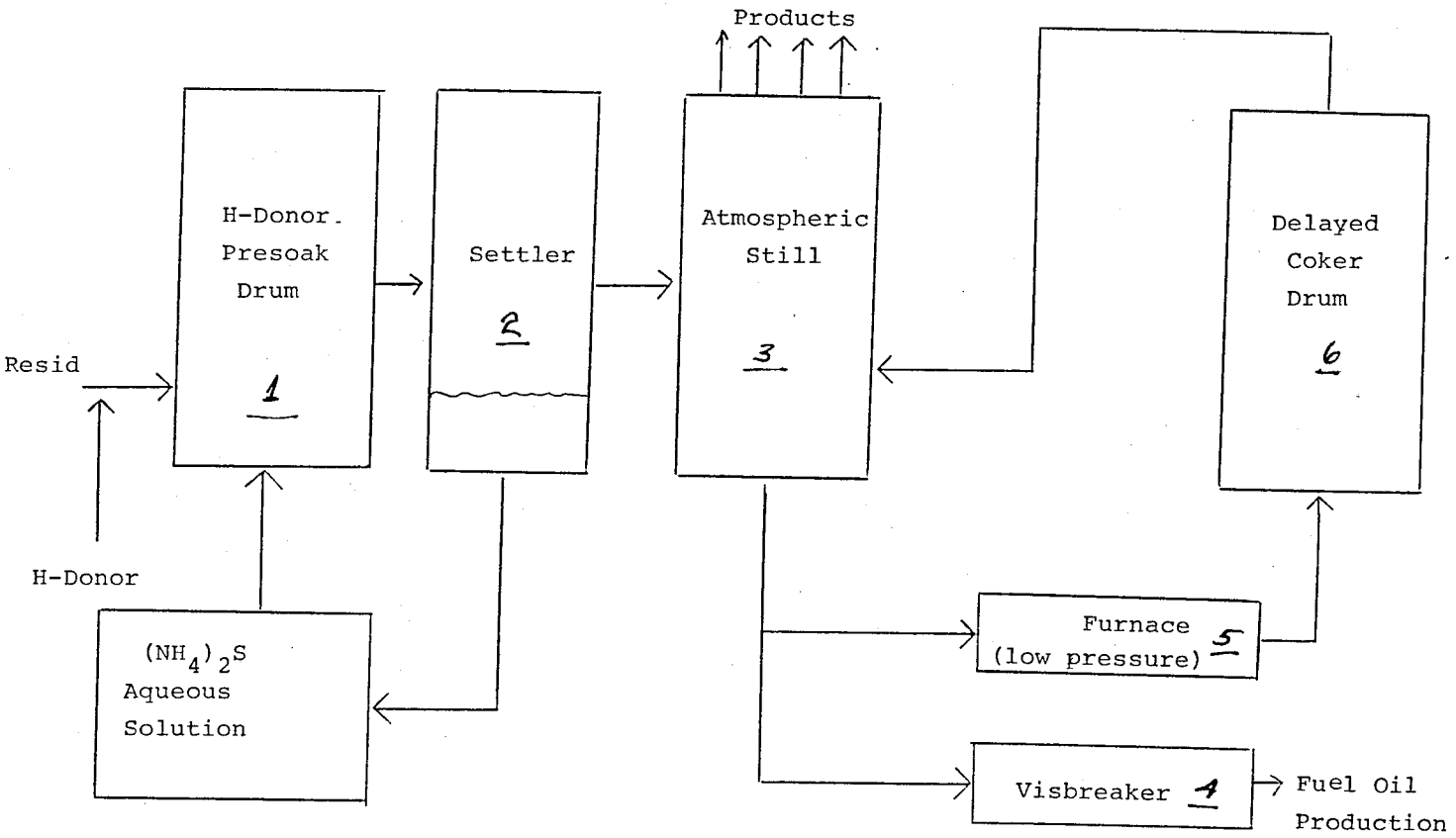
FIGURE 1. H-Donor Presoak with Aqueous Ammonium Sulfide Catalyst

ACCELERATED CRACKING OF RESIDUAL OILS AND HYDROGEN DONATION UTILIZING AMMONIUM SULFIDE CATALYSTS

NATURE OF INVENTION

This invention is concerned with the hydrogen donor diluent cracking of residual crude oils, particularly vacuum reduced crudes.

BACKGROUND OF THE INVENTION

The addition of a hydrogen donor to a residual oil prior to a coking or visbreaking operation is known to decrease markedly the amount of coke made and to improve the quality of the overhead product by increasing the yield of distillate. Typical hydrogen donors are tetralin from the hydrogenation of naphthalene, alkyl substituted tetralin, hydrogenated anthracenes, phenanthrenes, pyrenes, and the hydrogenated derivatives of other condensed ring aromatics. In such processes the hydrogen donor functions to supply hydrogen to thermally cracked hydrocarbon fragments thereby reducing coke formation and providing a superior cracked product. The actual hydrogen donation can be carried out on the resid in a heat-soak drum before the coking or visbreaking operation or it can take place during the coking or visbreaking operation. One problem with hydrogen donation in using a heat soak drum is the length of time it takes for the hydrogen to be transferred to the resid.

A primary object of this invention is to provide a means of accelerating the transfer of hydrogen from the donor to the resid during the heat soaking operation prior to a visbreaking or coking operation.

DESCRIPTION OF THE DRAWING

The accompanying drawing is a flow sheet depicting one aspect of the method of this invention.

SUMMARY OF THE INVENTION

Briefly stated this invention comprises adding to the hydrogen donor or to the resid feedstock to be subjected, in the presence of a hydrogen donor, to a cracking, visbreaking, or coking operation an aqueous solution of ammonium sulfide $(NH_4)_2S$.

DESCRIPTION OF THE INVENTION

With reference now to the flow sheet in the accompanying drawing a selected hydrogen donor such as tetralin, alkyl substituted tetralin, hydrogenated anthracenes, phenanthrenes, pyrenes, or the hydrogenated derivatives of other condensed ring aromatics is mixed with the petroleum resid, such as a vacuum resid, to be subjected to coking or visbreaking and is carried into a presoak drum 1. Alternatively, the resid and hydrogen donor can be introduced into the heat-soaking drum in separate streams. There is also introduced into the presoak drum an aqueous solution of ammonium sulfide $(NH_4)_2S$. The concentration of ammonium sulfide in the aqueous solution preferably is between 1 and 30 weight percent. The weight ratio of ammonium sulfide solution to hydrogen donor should be between 0.1:1 and 10:1. The weight ratio of hydrogen donor material to the incoming resid can be determined by those skilled in the art, but ordinarily will be between 0.1:1 and 5:1. Residence time of the resid plus H-donor and ammonium sulfide solution in the presoak drum will depend on temperature and can range from 0.01 hours to 1000 hours at temperatures ranging between 600° F. and 900° F. and a pressure of 15 to 2000 psig. At 650° F., residence time will range from 5–300 hours; at 750° F. the range will be from 20 minutes to 15 hours while at 800° F. the soak time will be from 5 minutes to 3 hours. At higher temperatures shorter residence times will be used. The mixture of resid, hydrogen donor and aqueous ammonium sulfide solution is then flowed into a settling tank 2 where the water phase settles to the bottom, is removed, and is recycled to the operation. The supernatant petroleum residue phase is carried to a still 3 where overhead products are taken off at a temperature of 300° to 600° F. The liquid bottom product from the still is then carried to either a visbreaking operation 4 or through a low pressure (15 to 400 psig) furnace 5 and to a delayed coker operation drum where it is converted to coke and an overhead product which is removed and returned to the atmospheric still.

Addition of aqueous ammonium sulfide solution to a heat soak operation containing one of the hydrogen donors listed above gives about the same level of tetralin and 1050° F.+ conversion in about one-sixth of the time. Higher severity visbreaking of this resid can be carried out without sediment formation in the resulting fuel oil. If the resid from the heat soak hydrogen donation step is to be coked, more overall liquid product results if the pre heat-soak operation is first used.

Aqueous ammonium sulfide solutions can be synthesized from hydrogen sulfide and ammonia refinery off-gases. This synthesized ammonium sulfide is readily soluble in water and can easily be stored in aqueous solution in tanks prior to use. Since ammonium sulfide solution is more dense than resid, it can be separated easily in a settler tank after reaction.

EXAMPLES

A vacuum resid having the properties shown in Table 1 was chosen for the tests described herein.

TABLE 1

| Properties of Vacuum Resid | |
|---|---|
| Carbon, (%) | 82.98 |
| Hydrogen | 9.57 |
| Nitrogen | 0.73 |
| Oxygen | 0.46 |
| Sulfur | 5.35 |
| Ash | 0 |
| Nickel, ppm | 106 |
| Vanadium, ppm | 665 |
| CCR % | 27.3 |
| Saturates, wt % | 4.40 |
| Aromatic Oils | 19.60 |
| Resins | 45.40 |
| Asphaltenes | 30.60 |
| $C_7$-Solubles, wt % | 73.71 |
| $C_7$-Insolubles, wt % | 26.29 |
| 1050° F.+, wt % | 88.46 |

The above described vacuum resid was then tested as described in the following examples. Test results are reported in Tables 2 and 3.

EXAMPLE 1

In Run No. 1, 75.2 grams of vacuum resid and 22.5 grams of tetralin were put into a 300-cc autoclave. The autoclave was then pressured with helium to a pressure of 200 psig and the autoclave was heated to 650° F. for 15.5 hours with stirring. The autoclave was then cooled with ice to return it to room temperature. The results of this test reported in Table 1 show that 9.82 percent of tetralin was converted to naphthalene indicating some hydrogen donation to the resid. No conversion of the fraction boiling above 1050° F.+, however, occurred in the absence of any added aqueous ammonium sulfide.

EXAMPLE 2

In Run No. 2, 50 grams of the vacuum resid and 15 grams of tetralin were added to a 300-cc autoclave with 12 grams of a 20% aqueous solution of ammonium sulfide. The autoclave was sealed and heated to 650° F. for 16 hours and then quenched for rapid cooling to room temperature. In this run 26.44% of the tetralin was converted to naphthalene and 23.4% of the 1050° F.+ resid was converted as well. A 20.96% conversion to distillate resulted. In comparing this run with Run No. 1, it becomes evident that the aqueous ammonium sulfide addition to the resid and tetralin accelerated both the hydrogen donation and cracking reactions. When tetralin and ammonium sulfide were reacted for 16 hours at 650° F. in a separate blank run, (not reported in the tables) less than 2% of the tetralin was converted to naphthalene. Clearly, the ammmonium sulfide was not reacting with the tetralin.

EXAMPLE 3

Run No. 3 was conducted under conditions similar to those of Run No. 1 using only resid and tetralin in an autoclave. In this run, however, the reactants were heat-soaked for 65 hours in a hydrogen sulfide atmosphere, and 21.35% conversion of tetralin and 9.47% conversion of the 1050° F.+ fraction occurred. These results reported in Table 3 show less conversion achieved than that at 16 hours in Run No. 2 with the added aqueous ammonium sulfide. Run No. 3 also illustrates that hydrogen sulfide does not effect great improvements in the conversion of tetralin or 1050° F.+ fraction under these mild conditions. This demonstrates that the ammonium sulfide and not the hydrogen sulfide from the decomposed ammonium sulfide acts as a catalyst.

EXAMPLE 4

Run No. 4 was conducted in much the same manner as Run Nos. 1 and 3 except the heat-soak time was extended to 96 hours. This extended period of heat-soaking was required to attain a 22% conversion of the 1050° F.+ fraction, the equivalent of the conversion achieved with the shorter heat-soak period of Example 2 in which aqueous ammonium sulfide was used. Thus a factor of six times more soak-time at 650° F. is needed to achieve about the same level of coversion as that attained when the aqueous ammonium sulfide is present.

TABLE 2

| | Comparison of Heat Soak Runs at 650° F. | | | |
|---|---|---|---|---|
| | Feedstock | Run Number 1 | Run Number 2 | Run Number 4 |
| Treatment, Heat Soak for | | 15.5 Hrs. | 16 Hr.rs. | 96 Hrs. |
| Fraction | 975+F. | | | |
| Reference | 84–243 | 84–243 | 84–243 | 84–243 |
| Hydrogen Doner | | Tetralin | Tetralin | Tetralin |
| Ratio of Tetralin/Resid | | 0.30 | 0.30 | 0.30 |
| Ratio of $(NH_4)_2S$/Resid | | 0 | 0.24 | 0 |
| Pressure, psig | | 200 | ATM. | 200 |
| Gas | | Helium | Nitrogen | Helium |
| Coker Temperature °F. | | 650 | 650 | 650 |
| Total ERT (800° F.) (sec. at 800° F.) | | 316 | 480 | 2848 |
| Product Distribution, Percent | | | | |
| Gas–75° F. | | | 1.42 | |
| 75°–400° F. | | | 2.82 | |
| 400–800° F. | | | 7.62 | 10.19 |
| 800–1050° F. | | 10.32 | 19.64 | 21.60 |
| 1050+–Oil | | 89.68 | 44.04 | 68.21 |
| Heptane Insolubles | | | 23.72 | |
| Conversion to Distillate | | −1.38 | 20.96 | 22.89 |
| Conversion to 1050 - G + D | | −1.38 | 22.57 | 22.89 |
| 1050+ Conversion | | −1.38 | 23.40 | 22.89 |
| Conversion of Tetralin | | 9.82 | 26.44 | 44.89 |

TABLE 3

| | 65 Hours Heat Soak at 650° F./$H_2S$ |
|---|---|
| | Run Number 4 |
| Treatment, Heat Soak for | 65 Hrs. |
| Fraction | |
| Reference | 84–243 |
| Hydrogen Doner | Tetralin |
| Ratio of Tetralin/Resid | 0.30 |
| Ratio of $(NH_4)_2S$/Resid | 0 |
| Pressure, psig | 200 |
| Gas | $H_2S$ |
| Coker Temperature °F. | 650 |
| Total ERT (800° F.)(sec. at 800° F.) | 1928 |
| Product Distribution, Percent | |
| Gas–75° F. | |
| 75°–400° F. | |
| 400–800° F. | 12.35 |
| 800–1050° F. | 7.57 |
| 1050+–Oil | 80.08 |
| Conversion to Distillate | 9.47 |
| Conversion to 1050 - G + D | 9.47 |
| 1050+ Conversion | 9.47 |
| Conversion of Tetralin | 21.35 |

Thus, the addition of aqueous ammonium sulfide solution to the hydrogen donor, such as tetralin, and the resid subjected to a heat-soaking step prior to coking, cracking, or visbreaking catalyzes the hydrogen donation of the donor and the conversion of the heavier material. The same level of hydrogen donor and heavy resid can be achieved in one-sixth of the time required by the incorporation of aqueous ammonium sulfide solution. Accelerating the reaction rates means more throughput and/or requires lower capacity equipment for hydrogen donation and conversion during heat-soaking. Reduced coke production and less sediment in fuel oil production is also a benefit.

I claim:

1. In a process for hydrogen donor diluent cracking of heavy hydrocarbon charge stock by mixing said charge stock with a hydrogen donor containing hydrogenated condensed ring aromatic compounds and reacting the mixture at thermal cracking conditions the improvement comprising adding to said hydrogen donor an aqueous solution of ammonium sulfide and maintaining said mixture in a presoaking zone for a period of about 0.01 to about 1000 hours and a temperature between about 600° F. and about 900° F. and a pressure of about 15 to about 2000 psig prior to reacting said reaction mixture at thermal cracking conditions.

2. The process of claim 1 wherein the hydrogen donor is selected from the group consisting of tetralin, alkyl substituted tetralin, and hydrogenated anthracenes, phenanthrenes, and pyrenes.

3. The process of claim 1 wherein the concentration of ammonium sulfide in the aqueous solution is between about 1 and about 30 weight percent.

4. The process of claim 3 wherein the ratio of weight of aqueous ammonium sulfide to hydrogen donor is between about 0.1:1 and about 10:1.

5. The process of claim 1 wherein the aqueous solution of ammonium sulfide is added to the hydrogen donor prior to mixing with said resid.

6. A process for preparing a petroleum resid for cracking, coking, or visbreaking comprising: (a) adding to said petroleum resid a hydrogen donor and (b) adding to said petroleum resid an aqueous solution of ammonium sulfide and maintaining the resulting mixture in a presoaking zone for a period of about 0.01 to about 1000 hours and a temperature between about 600° F. and about 900° F. and a pressure of about 15 to about 2000 psig prior to reacting said reaction mixture at thermal cracking conditions.

7. The process of claim 6 wherein the hydrogen donor is selected from the group consisting of tetralin, alkyl substituted tetralin, and hydrogenated anthracenes, phenanthrenes, and pyrenes.

8. The process of claim 6 wherein the concentration of ammonium sulfide in the aqueous solution is between about 1 and about 30 percent.

9. The process of claim 8 wherein the ratio of aqueous ammonium sulfide to hydrogen donor is between about 0.1:1 and about 10:1.

* * * * *